US006712224B2

(12) United States Patent
Ling

(10) Patent No.: US 6,712,224 B2
(45) Date of Patent: Mar. 30, 2004

(54) TOOL RACK ASSEMBLY

(75) Inventor: David Ling, Taichung (TW)

(73) Assignee: Hand Tool Design Corporation, Christiana, DE (US)

( * ) Notice: Subject to any disclaimer, the term of this patent is extended or adjusted under 35 U.S.C. 154(b) by 0 days.

(21) Appl. No.: 09/906,525

(22) Filed: Jul. 16, 2001

(65) Prior Publication Data

US 2003/0010733 A1 Jan. 16, 2003

(51) Int. Cl.[7] ..... A47F 7/00
(52) U.S. Cl. ..... 211/70.6; 206/376
(58) Field of Search ..... 211/70.6, 87.01; 206/376, 377, 378

(56) References Cited

U.S. PATENT DOCUMENTS 992,235 A * 5/1911 Johnson
2,805,777 A * 9/1957 Larson ..... 211/87.01 X
5,598,924 A * 2/1997 McCann ..... 211/70.6 X
5,730,303 A * 3/1998 Chow ..... 211/70.6
5,893,542 A * 4/1999 Hu ..... 211/70.6 X
D412,844 S * 8/1999 Kopala, Jr.
5,988,381 A 11/1999 Ling ..... 206/349
6,039,188 A * 3/2000 Lee ..... 206/378 X
6,126,004 A * 10/2000 Ling ..... 206/378 X
RE37,129 E 4/2001 Chow ..... 206/349
6,360,892 B1 * 3/2002 Chen ..... 206/376
6,375,005 B1 * 4/2002 McCann ..... 206/376 X
6,401,923 B1 * 6/2002 Huang ..... 206/376
6,409,015 B1 * 6/2002 Hu ..... 206/378
6,464,840 B1 * 10/2002 McCann ..... 211/70.6 X
6,523,687 B2 2/2003 Ling ..... 206/378
2003/0080076 A1 5/2003 Hu ..... 211/70.6

* cited by examiner

*Primary Examiner*—Robert W. Gibson, Jr.
(74) *Attorney, Agent, or Firm*—Nelson Mullins Riley & Scarborough, LLP

(57) ABSTRACT

A tool rack assembly includes a board and a tool rack detachably mounted to the board. In another embodiment, a tool try-on device is provided including a board and a rotating member rotatably mounted to the board. The rotating member is engageable with an end of a tool. The rotating member moves in a direction transverse to a plane on which the board lies when the tool engaged with the rotating member is turned.

21 Claims, 9 Drawing Sheets

A-A

B-B

C-C

TOOL RACK ASSEMBLY

BACKGROUND OF THE INVENTION

1. Field of the Invention

The present invention relates to a tool rack assembly. In particular, the present invention relates to a tool rack assembly comprising a board and a tool rack releasably attached to the board. The present invention also relates to a tool try-on device allowing try-on of a tool.

2. Description of the Related Art

A conventional tool pack, when holding a multiplicity of tools of different kinds and sizes, occupies a considerable space and is bulky and thus inconvenient for carriage and storage. Management of the tools may be a problem in some cases. Some of the tool racks provide a try-on function allowing the customer to try-on the tool before buying it. However, the rotating member on the tool rack rotates freely, which is unlike transverse movement of that in real operation.

SUMMARY OF THE INVENTION

An object of the present invention is to provide a tool rack assembly comprising a board and a tool rack releasably attached to the board. The board serves as a display device when the tool rack having tools mounted thereon is attached thereto. Thus, the user may select the required tools and place them on the tool rack, which, in turn, can be releasably attached to the board conveniently. The tool rack is tied to the board during display, thereby preventing theft. The tool rack can be detached from the board and thus be used separately. In addition, one may try-on the tool before buying it, and the operation imitates the real operation by allowing a rotating member rotatably mounted to the board to move along a transverse direction during operation of the tool.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
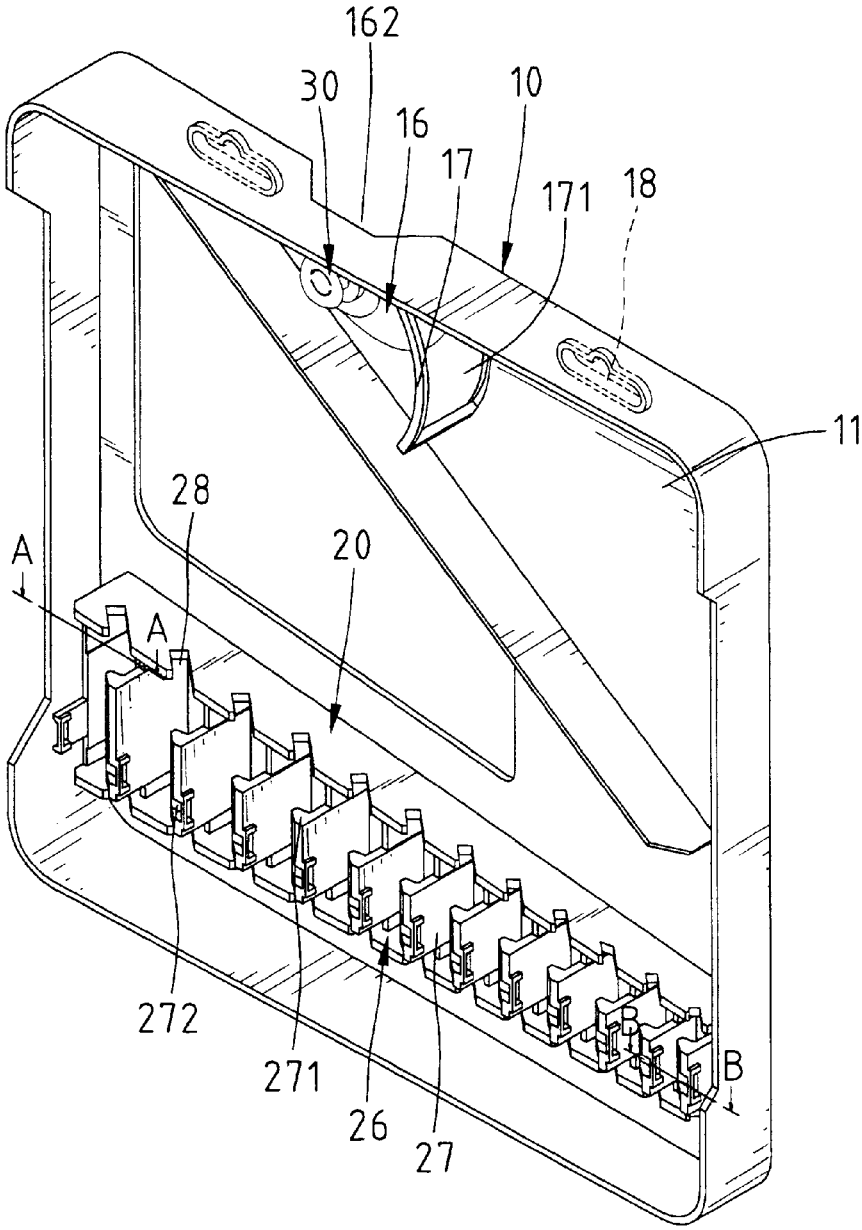
FIG. 1 is a perspective view of a tool rack assembly in accordance with the present invention.
Figure 2:
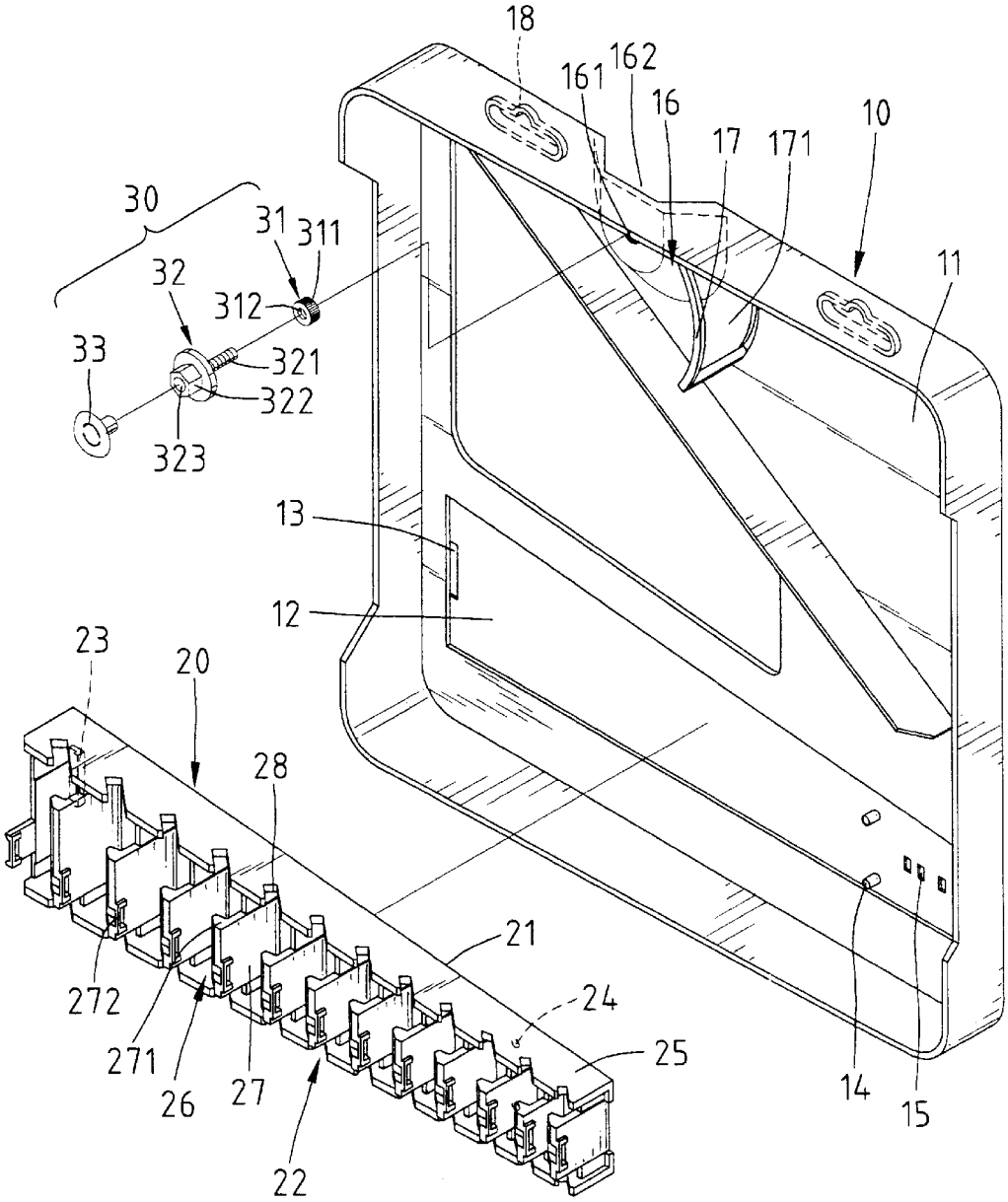
FIG. 2 is an exploded perspective view of the tool rack assembly in accordance with the present invention.

Referring to FIGS. 1 and 2, a tool rack assembly in accordance with the present invention generally includes a board 10 and a tool rack 20 releasably attached to the board 10. The board 10 includes a tool rack compartment 12 having a slot 13 on an end thereof and two pegs 14 as well as a plurality of openings 15 on the ocher end thereof. The board 10 further comprises a hanging hole 18 so as to allow hanging of the board 10 to a wall. The board 10 further comprises a try-on space 11 in which a bulge 16 is defined. A recess 162 may be defined in a rear side of the board 10 and behind the bulge 16. A rotating means 30 may be provided on the bulge 16 on the board 10 to allow a potential customer to try on the tools held on the tool rack 20. A restraining frame 17 with an opening 171 is provided in the try-on space 11 of the board 10 to limit rotational movement of a wrench to be tried on, which will be described later.

Figure 5:
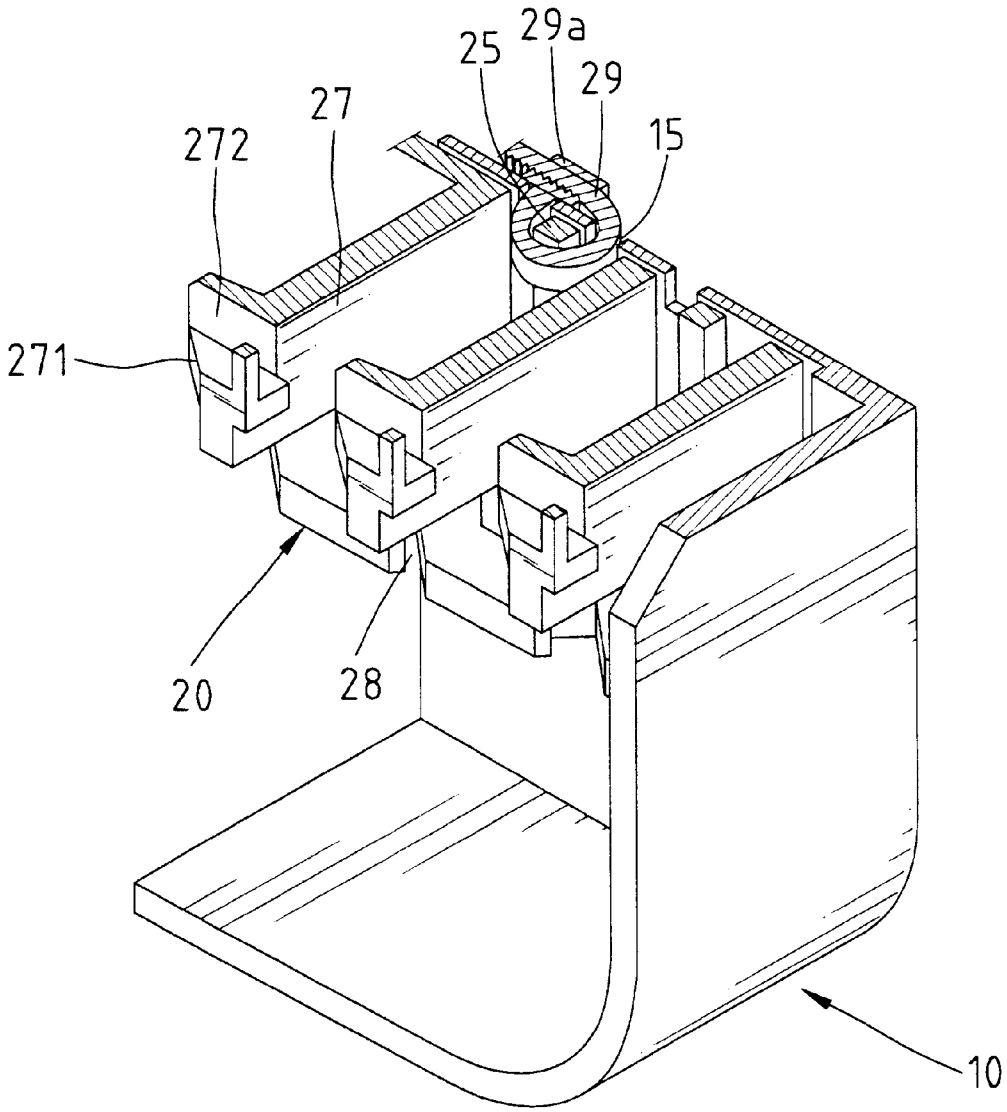
FIG. 5 is a perspective view illustrating a portion of the tool rack assembly and sectioned along plane B—B in FIG. 1.

The tool rack 20 comprises a first side 21 and a second side 22 that is opposite to the first side 21. An engaging hook 23 is provided on an end of the first side 21 for releasably engaging with the slot 13 of the tool rack compartment 12. Two holes 24 are defined in the other end of the first side 21 for releasably engaging with the pegs 14 of the tool rack compartment 12. After the tool rack 20 is mounted in the tool rack compartment 12, a tying strip 29 is used to tie up the former to the latter. As illustrated in FIG. 5, a flexible enlarged end 29*a* of the tying strip 29 outside the board 10 is passed through one of the openings 15 in the board 10, wound around a rib 25 formed on the tool rack 20, and passed through another opening 15 in the board 10 and a tightening hole in the tying strip 29. Thus, the tool rack 20 is fixedly tied up to the board 10. Removal of the tool rack 20 is allowed only when the tying strip 29 is severed.

Figure 3:
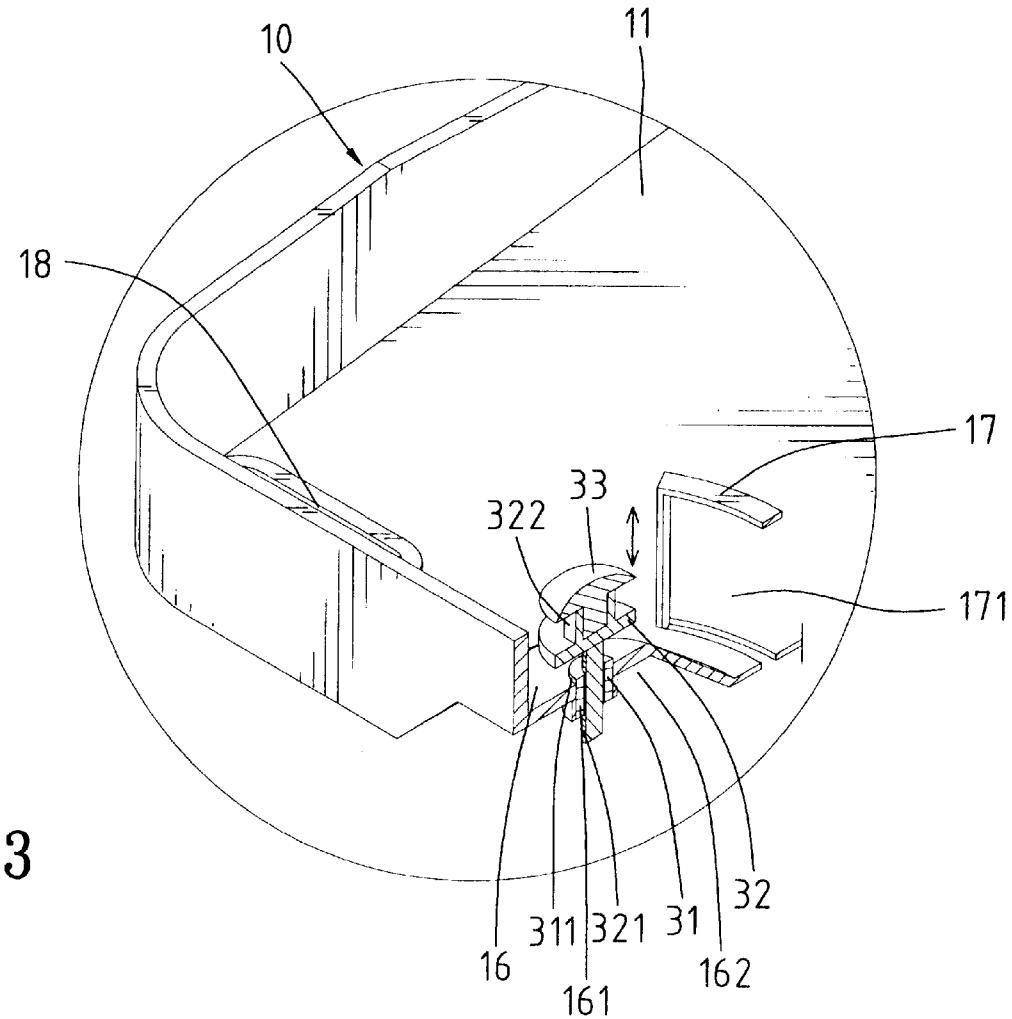
FIG. 3 is an enlarged perspective view of a rotating means mounted on the tool rack assembly in accordance with the present invention.
Figure 4:
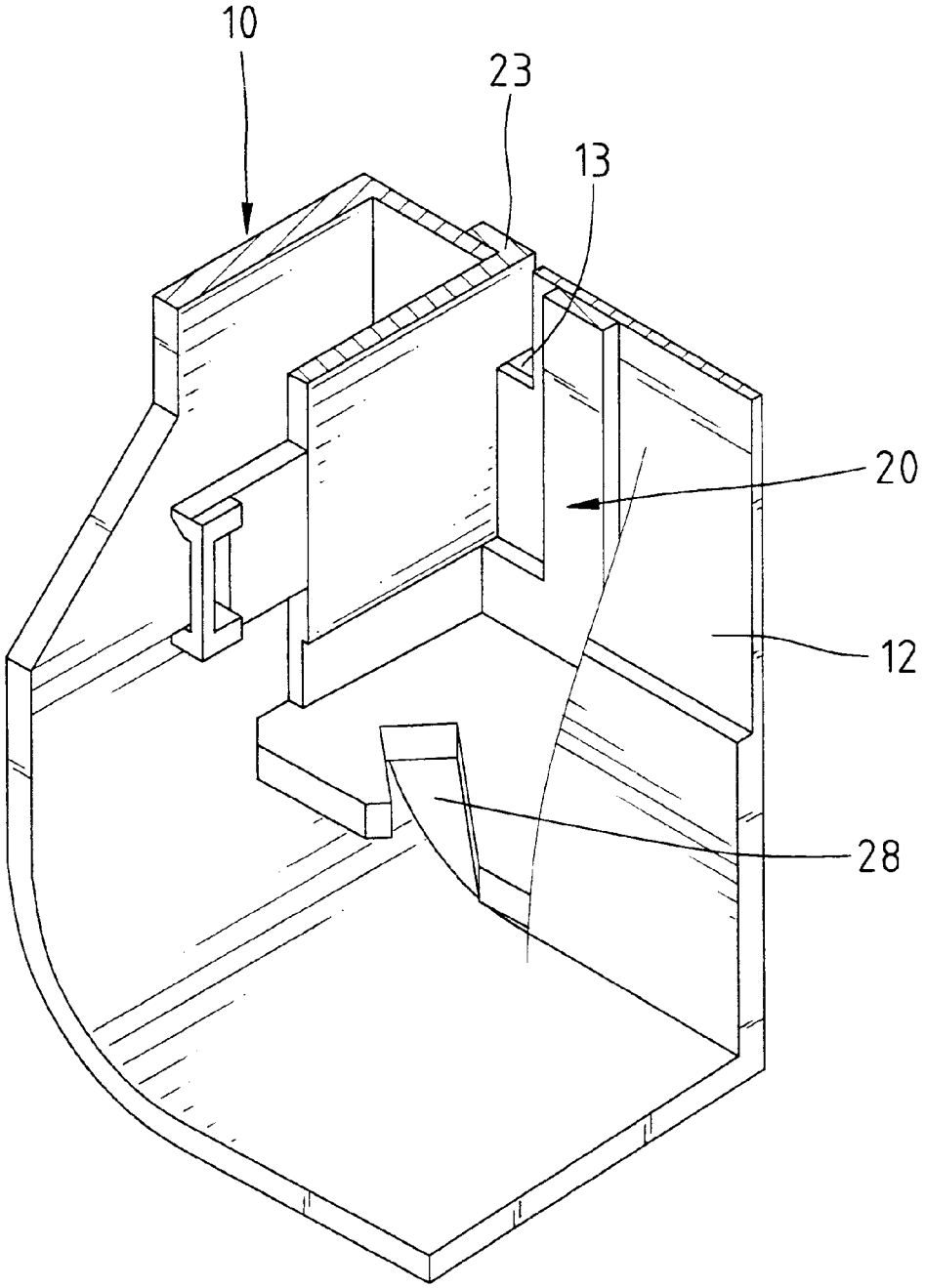
FIG. 4 is a perspective view illustrating a portion of the tool rack assembly and sectioned along plane A—A in FIG. 1.
Figure 6:
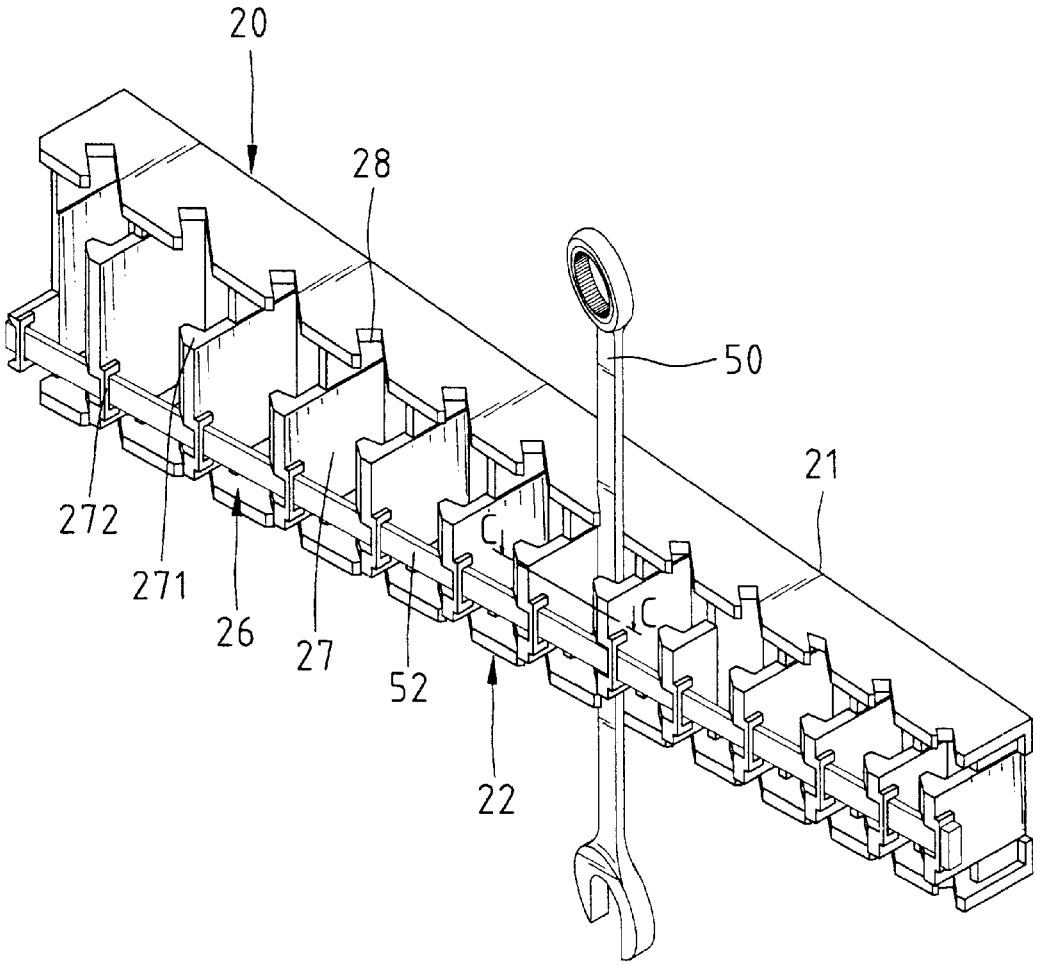
FIG. 6 is a perspective view illustrating a tool rack of the tool rack assembly in accordance with the present invention.
Figure 7:
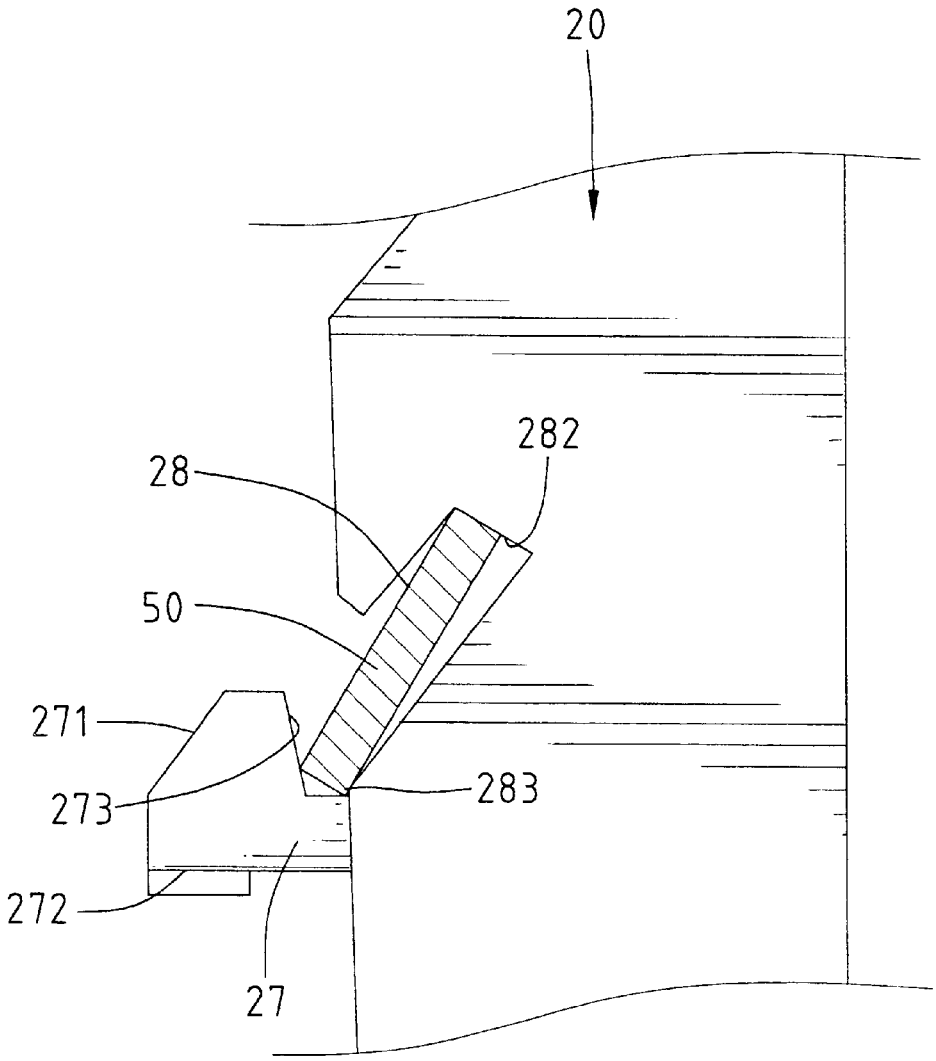
FIG. 7 is a sectional view, in an enlarged scale, taken along plane C—C in FIG. 6.

Provided on the second side 22 of the tool rack 20 are plural tool-holding portions 26 each having a tool-holding seat 27 and a pair of vertically aligned retaining grooves 28 that extend along a direction at an angle with a longitudinal direction of the tool rack 20. Each tool-holding seat 27 includes an inclined outer guide face 271 in an outer end thereof and a locking slot 272. A tool, e.g., a combination wrench 50 (FIGS. 6 and 7) is guided into a respective pair of retaining grooves 28 by the inclined guide face 271 of a respective tool-holding seat 27 that can be slightly deformed. Namely, the combination wrench 50 slides across the respective inclined outer guide face 271 into the respective pair of retaining grooves 28 and is then securely retained in the respective pair of retaining grooves 28 by an inner retaining face 273 of the outer end of the respective tool-holding seat 27 and a corresponding face 282 and a corresponding corner 283 defining each of the respective retaining grooves 28, best shown in FIG. 7. After all of the tools 50 are retained in place, a locking strip 52 can be extended through the locking slots 272 of the tool-holding seats 27 to prevent theft, best shown in FIG. 6. Referring to FIGS. 2 and 3, the rotating means 30 comprises a fixed element 31 that is securely mounted in a hole 161 (e.g., a screw hole) of the bulge 16 of the board 10. In this embodiment, the fixed element 31 has a toothed outer periphery 311 for secure engagement with the screw hole 161 of the bulge 16. In addition, the rotating means 30 comprises a rotating member 32 having a threaded stem 321 in threading engagement with a screw hole 312 of the fixed element 31. The rotating member 32 further has a tool-engaging portion 322 in the form of a nut for engaging with an end of a tool, such as a combination wrench. A cap 33 can be engaged with a hole 323 in the tool-engaging portion 322 for preventing disengagement of the tool engaged with the tool-engaging portion 322.

Figure 8:
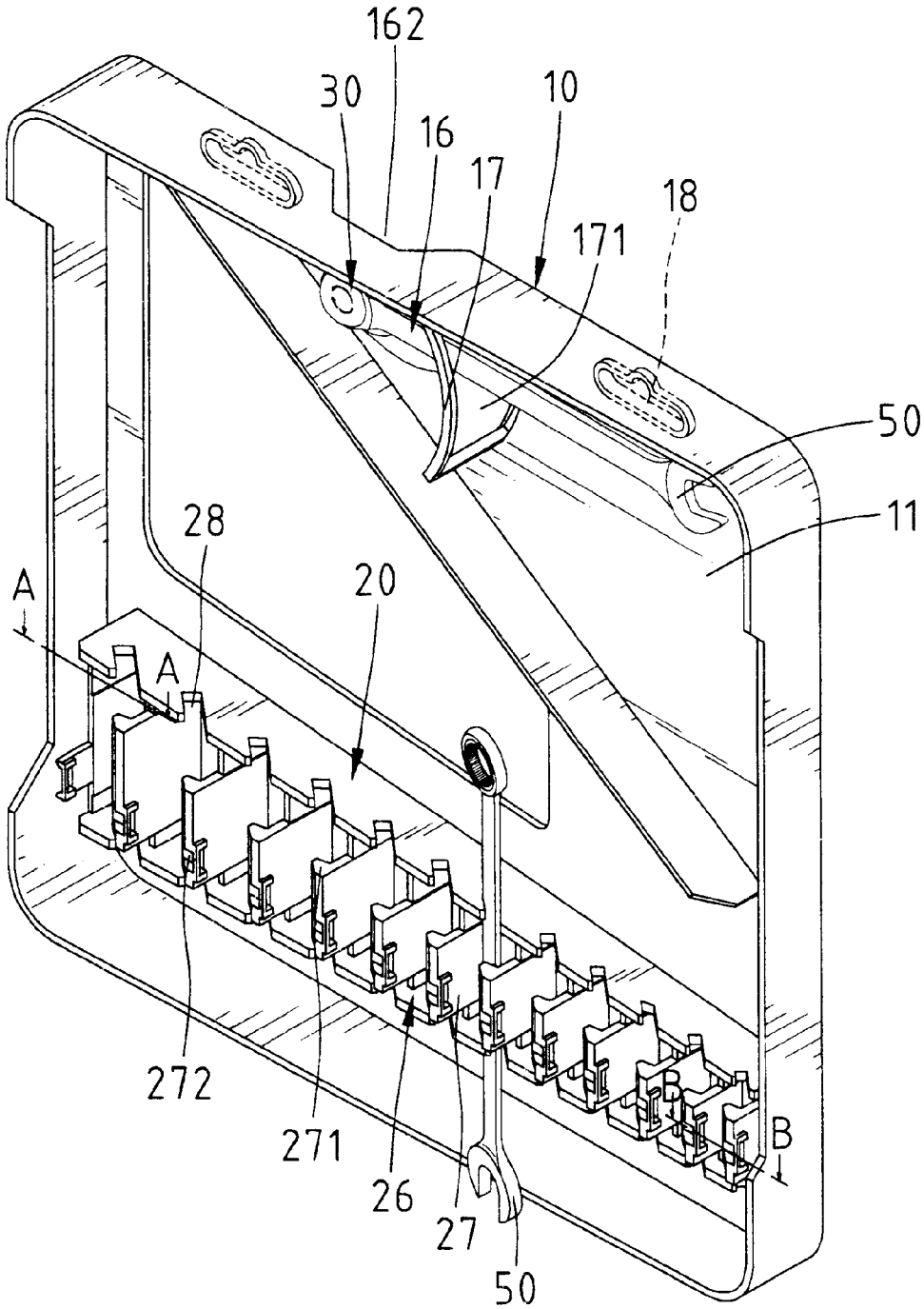
FIG. 8 is a schematic view illustrating a try-on function provided by the tool rack assembly in accordance with the present invention.

As illustrated in FIG. 8, a combination wrench 50 is extended through an opening 171 in the restraining frame 17 with an end of the combination wrench 50 engaging with the tool-engaging portion 322. Thus, one may try-on the combination wrench 50 by means of normally operating the combination wrench 50. As illustrated in FIG. 3, the rotating member 32 moves along a direction transverse to a plane on which the board 10 lies, thereby imitating the tightening/loosening operation of a fastener, e.g., a nut, bolt head, etc. The recess 162 of the board 10 allows free transverse movement of the rotating member 32.

Figure 9:
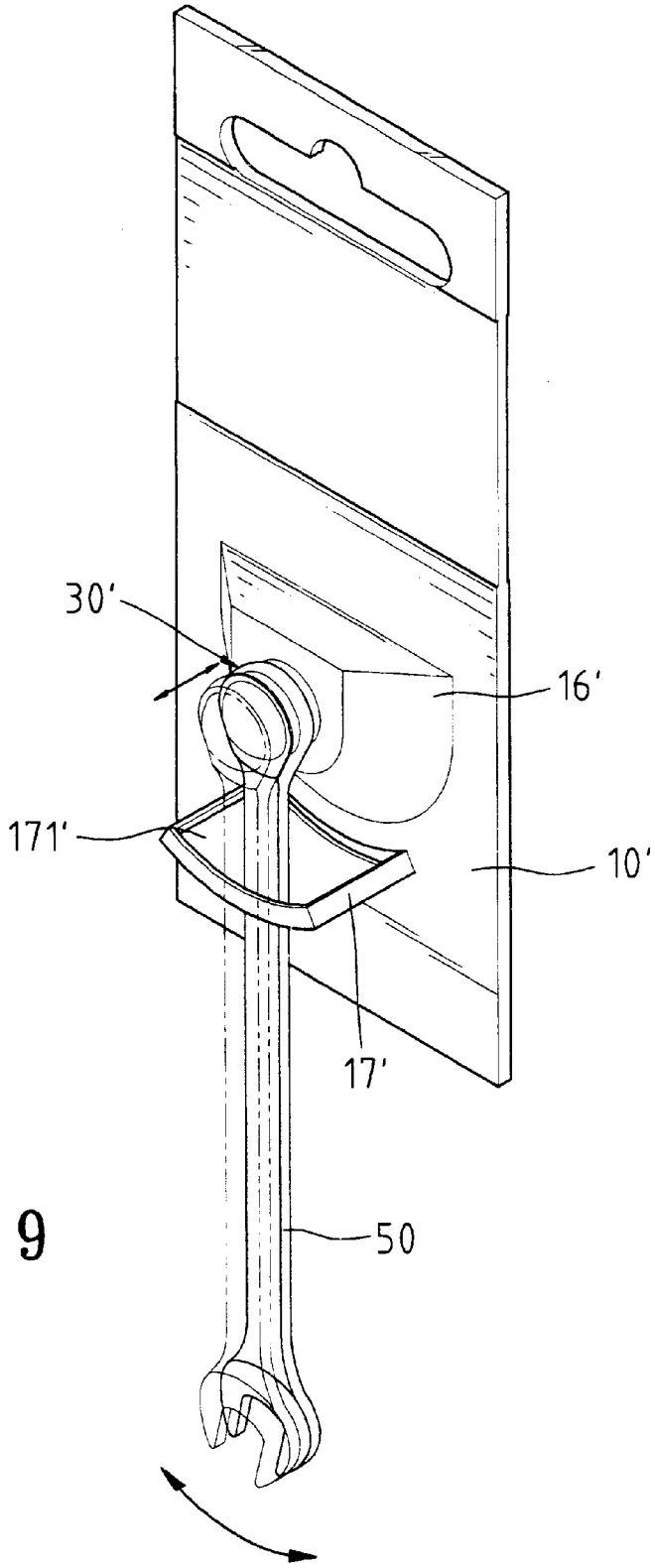
FIG. 9 is a perspective view illustrating a try-on device in accordance with the present invention.

FIG. 9 depicts a simplified try-on device in accordance with the present invention, wherein the try-on device comprises a board 10' including a bulge 16' to which the rotating means 30' is rotatably mounted for engaging with an end of a tool 50. Rotating movement of the tool 50 is restrained in an opening 171' of a restraining frame 17' that is integral with the board 10'. A recess (not shown) is defined behind the recess to allow free transverse movement of the rotating member 32.

According to the above description, the present invention provides a tool display assembly allowing a tool rack to be detachably mounted to a board. The board serves as a display device when the tool rack having tools mounted thereon is attached thereto. Thus, the user may select the required tools and place them on the tool rack, which, in turn, can be releasably attached to the board conveniently. The tool rack is tied up to the board during display, thereby preventing theft. The tool rack can be detached from the board and thus be used separately. In addition, one may try-on the tool before buying it, and the operation is imitating the real operation by allowing the rotating member to move along a transverse direction during operation of the tool.

Although the invention has been explained in relation to its preferred embodiment, it is to be understood that many other possible modifications and variations can be made without departing from the scope of the invention as hereinafter claimed.

What is claimed is:

1. A tool rack assembly comprising:

a board having a slot defined therein and at least one peg formed thereon; and a tool rack having a hook formed thereon for engagement with the slot and at least one hole for engagement with the at least one peg.

2. The tool rack assembly as claimed in claim 1, wherein the board comprises a tool rack compartment for receiving the tool rack.

3. The tool rack assembly as claimed in claim 2, further including a strip with a first end and an enlarged second end defining a hole, wherein the tool rack comprises a first hole, and the board comprises two second holes, and the first end of the strip can be extended through the first hole of the tool rack, the second holes of the board, and the hole defined in the enlarged second end of the strip in a manner that the tool rack is fixed to the board and thus cannot be detached from the board unless the strip is severed.

4. The tool rack assembly as claimed in claim 1, wherein the tool rack comprises a first side for engaging with the board and a second side for holding tools, the second side of the tool rack comprising a plurality of tool-holding portions each having a tool-holding seat and a pair of aligned retaining grooves extending along a direction at an angle with a longitudinal direction of the tool rack, each said tool-holding seat comprising an outer end having an outer guide face and an inner retaining face, a tool being guided by a respective said outer guide face into a respective pair of said retaining grooves and retained in place by a periphery defining each of the respective pair of retaining grooves and a respective said inner retaining face.

5. The tool rack assembly as claimed in claim 4, wherein each said tool-holding seat comprises a locking slot, further comprising a locking strip extending through the locking slot of each said tool-holding seat to prevent disengagement of the tool from the respective tool-holding portion.

6. A tool rack assembly comprising:

a board;

a tool rack detachably mounted on the board; and a rotating member mounted on the board for engaging with a tool so that the tool can be tried on the rotating member, the rotating member moving in a direction transverse to a plane on which the board lies when the tool is turned.

7. The tool rack assembly as claimed in claim 6, wherein the board comprises a bulge with a hole, further comprising a fixed element securely fixed in the hole of the bulge, the fixed element having a screw hole, the rotating member including a threaded stem engaged with the screw hole of the fixed element.

8. The tool rack assembly as claimed in claim 7, wherein the rotating member comprises a tool-engaging portion in the form of a nut for engaging with the tool.

9. The tool rack assembly as claimed in claim 8, wherein the nut comprises a hole, further comprising a cap for engaging with the hole of the nut to thereby prevent disengagement of the tool.

10. The tool rack assembly as claimed in claim 6, further comprising a restraining frame through which the tool extends, thereby restraining pivotal movement of the tool.

11. The tool rack assembly as claimed in claim 7, wherein the board comprises a recess behind the bulge for allowing free transverse movement of the rotating member.

12. The tool rack assembly as claimed in claim 4, further comprising a rotating member mounted on the board for engaging with a tool so that the tool can be tried on the rotating member, the rotating member moving in a direction transverse to a plane on which the board lies when the tool is turned.

13. The tool rack assembly as claimed in claim 12, wherein the board comprises a bulge with a hole, further comprising a fixed element securely fixed in the hole of the bulge, the fixed element having a screw hole, the rotating member including a threaded stem engaged with the screw hole of the fixed element.

14. The tool rack assembly as claimed in claim 13, wherein the rotating member comprises a tool-engaging portion in the form of a nut for engaging with the tool.

15. The tool rack assembly as claimed in claim 14, wherein the nut comprises a hole, further comprising a cap for engaging with the hole of the nut to thereby prevent disengagement of the tool.

16. A tool try-on device comprising a board and a rotating member mounted on the board for engagement with a tool so that the tool can be tried on the rotating member, the rotating member moving in a direction transverse to a plane on which the board lies when the tool is turned.

17. The tool rack assembly as claimed in claim 16, wherein the board comprises a bulge with a hole, further comprising a fixed element securely fixed in the hole of the bulge, the fixed element having a screw hole, the rotating member including a threaded stem engaged with the screw hole of the fixed element.

18. The tool rack assembly as claimed in claim 17, wherein the rotating member comprises a tool-engaging portion in the form of a nut for engaging with the tool.

19. The tool rack assembly as claimed in claim 18, wherein the nut comprises a hole, further comprising a cap for engaging with the hole of the nut to thereby prevent disengagement of the tool.

20. The tool rack assembly as claimed in claim 16, further comprising a restraining frame through which the tool extends, thereby restraining pivotal movement of the tool.

21. The tool rack assembly as claimed in claim 17, wherein the board comprises a recess behind the bulge for allowing free transverse movement of the rotating member.

* * * * *

UNITED STATES PATENT AND TRADEMARK OFFICE

CERTIFICATE OF CORRECTION

PATENT NO. : 6,712,224 B2
DATED : March 30, 2004
INVENTOR(S) : David Ling

It is certified that error appears in the above-identified patent and that said Letters Patent is hereby corrected as shown below:

Title page,
Item [56], References Cited, OTHER PUBLICATIONS, delete Patent No. "992,235" and replace with -- 992,203 --.

Column 2,
Line 4, please delete "ocher" and replace with -- other --.

Signed and Sealed this

Fourteenth Day of June, 2005

JON W. DUDAS
*Director of the United States Patent and Trademark Office*